US005771866A

United States Patent [19]

Staerzl

[11] Patent Number: 5,771,866

[45] Date of Patent: Jun. 30, 1998

[54] NOZZLE FOR LOW PRESSURE FUEL INJECTION SYSTEM

[75] Inventor: Richard E. Staerzl, Fond du Lac, Wis.

[73] Assignee: Brunswick Corporation, Lake Forest, Ill.

[21] Appl. No.: 881,770

[22] Filed: Jun. 24, 1997

[51] Int. Cl.[6] ..... F02M 23/00; F02B 23/00

[52] U.S. Cl. ..... 123/531; 123/585; 239/417

[58] Field of Search ..... 123/531, 533, 123/585; 239/416.5, 417, 423, 424, 499, 432

[56] References Cited

U.S. PATENT DOCUMENTS

| | | | |
|---|---|---|---|
| 2,769,670 | 11/1956 | Dunn | 239/417 |
| 3,015,449 | 1/1962 | Meyer | 239/417 |
| 4,000,613 | 1/1977 | Fukumoto et al. | 239/417 |
| 4,391,254 | 7/1983 | Staerzl | 123/478 |
| 4,750,464 | 6/1988 | Staerzl | 123/494 |
| 4,763,626 | 8/1988 | Staerzl | 123/438 |
| 4,840,148 | 6/1989 | Staerzl | 123/73 A |
| 4,889,287 | 12/1989 | Hemsley | 239/499 |
| 4,922,866 | 5/1990 | Staerzl | 123/73 |
| 5,421,311 | 6/1995 | Wataya | 123/585 |
| 5,601,059 | 2/1997 | White | 123/184.21 |
| 5,699,776 | 12/1997 | Wood et al. | 123/585 |

*Primary Examiner*—Thomas N. Moulis
*Attorney, Agent, or Firm*—William D. Lanyi

[57] ABSTRACT

A nozzle is provided for a fuel injection system in which a cap is disposed around a common termination of a first and second conduit. The first and second conduits are associated in coaxial and concentric relation with each other. A liquid fuel is transmitted through the first conduit and air is transmitted through the second conduit. The air is taken into the second conduit at atmospheric pressure without the need for an air compressor. An opening is formed in the cap of the nozzle to allow the fine mist formed at the common termination of the first and second conduit to flow out of the nozzle and into an air stream, such as within an intake manifold, for transport in the air stream to the combustion chamber of a cylinder within the internal combustion engine.

20 Claims, 3 Drawing Sheets

NOZZLE FOR LOW PRESSURE FUEL INJECTION SYSTEM

BACKGROUND OF THE INVENTION

1. Field of the Invention

The present invention is generally related to a nozzle and, more particularly, to a nozzle that uses two coaxial and concentric tubes to transport liquid fuel and air to a cap structure wherein a mist is formed and ejected through an opening in the cap structure.

2. Description of the Prior Art

In order to assure the proper operation of an internal combustion engine, it is necessary to suspend a mist of liquid fuel within an air stream that is passing into the combustion chamber of the engine. This function has been performed by carburetors and various types of fuel injection systems. Some nozzle configurations used in fuel injection systems require air to be provided, at a high pressure, from a compressor.

U.S. Pat. No. 4,922,866, which issued to Staerzl et al on May 8, 1990, discloses a fuel injector assembly and a low pressure fuel injection system that incorporates the fuel injector assembly. The assembly includes a fastener housing that functions to secure a reed valve block to a mounting plate which separates the air intake manifold from the crankcase of the internal combustion engine. A fuel injector or check valve is secured to the fastener housing so that fuel directed to the fuel injector passes through the mounting plate and into the crankcase at a location in the vicinity of the airflow outlet from the reed valve block.

U.S. Pat. No. 5,601,059, which issued to White et al on Feb. 11, 1997, describes a fuel distribution insert for an internal combustion engine. The injection molded plastic fuel distribution insert is intended for use with an internal combustion engine having a wet manifold for the purpose of promoting complete fuel atomization and vaporization. The fuel distribution insert also provides for even fuel distribution to the various combustion chambers of the engine. The fuel distribution insert preferably has a flange integral with one or more downwardly extending shrouds. Each shroud defines a subchamber having a volume substantially less than the volume of the manifold plenum. A fuel-air mixture from a fuel-air supply source enters into the shroud at the inlet of the intake manifold and is retained within the shroud until the mixture exits one or more exit windows in the shroud. The exit windows in the shroud are placed at locations to promote even fuel distribution.

U.S. Pat. No. 4,750,464, which issued to Staerzl on Jun. 14, 1988, discloses a mass flow fuel injection control system. The system is provided for internal combustion engine and measures mass and flow velocities of combustion air. The length of fuel injection pulses is determined by a formula. The system directly determines fuel requirements from the air mass flow and automatically self adjusts and tracks such requirements from engine to engine or with modifications to the engine without a preprogrammed lookup table according to throttle sensing and eliminates a need for a throttle position sensor.

U.S. Pat. No. 4,763,626, which issued to Staerzl on Aug. 16, 1988, discloses a feedback fuel metering control system. This system is provided for an internal combustion engine and eliminates the need for high pressure fuel injectors, a high pressure fuel pump and a constant fuel pressure regulator. The system senses the amount of combustion air supplied to the engine, senses fuel flow velocity, and controls the amount of fuel supplied according to the amount of combustion air and the fuel flow velocity.

U.S. Pat. No. 4,840,148, which issued to Staerzl on Jun. 29, 1989, describes a two cycle engine with a low pressure crankcase fuel injection system. The system includes a low pressure fuel pump and a solenoid valve supplying and metering fuel to the engine crankcase through a fuel line, without a carburetor, without a high pressure fuel pump, without high pressure fuel injectors, and without a constant fuel pressure regulator. The system senses the amount of combustion air supplied to the engine and senses fuel flow velocity using a restriction orifice in the fuel line producing a fuel pressure drop indicating fuel flow velocity. A conduit is connected between the crankcase at a transfer passage and the fuel line downstream of the restriction orifice and passes warm pressurized air-fuel mixture from the crankcase through the transfer passage to the fuel line in order to improve fuel atomization.

U.S. Pat. No. 4,391,254, which issued to Staerzl on Jul. 5, 1983, describes an atomization compensation system for an electronic fuel injection system. The atomization compensation apparatus is used in conjunction with an electronic fuel injection circuit for an internal combustion engine. For a four cycle engine, operating at low engine speed, the fuel has a tendency to fall out of suspension in the intake manifold, especially when the intake manifold air temperature is low. The described system gradually increases the fuel flow to the engine as an inverse function of low engine speed and intake manifold air temperature in order to provide atomization compensation.

It is significantly advantageous to use a fuel injection system that does not require a high pressure supply of air for the fuel injectors to operate properly. The patents described above, all of which are hereby expressly incorporated by reference in this description, relate to internal combustion engines and the various ways that fuel can be supplied to the combustion chambers of those engines. It is very important that the fuel-air mixture comprises very small suspended droplets of liquid fuel within an air stream. If the droplets are too large, incomplete combustion occurs and unburned fuel can be passed through the exhaust system of the engine. If the fuel-air mixture is not provided in a fine mist to the combustion chamber, proper operation of the internal combustion engine will not occur. These problems are particularly troublesome when the internal combustion engine is operated at a low speed, such as at idle speed. The flow of air to the injector, particularly when the air is at atmospheric pressure and not provided by a high pressure air compressor, can be reduced to a very low flow. As a result, the liquid fuel provided to the fuel injector can possibly form puddles or very large droplets, causing erratic and uneven operation of the engine.

It would therefore be significantly beneficial if a nozzle could be developed that allows liquid fuel to be provided in a fine mist, using low pressure air, even when the engine is operating at low speeds.

SUMMARY OF THE INVENTION

A nozzle made in accordance with the present invention comprises a first conduit for conducting a flow of liquid fuel from a fuel source, such as a fuel pump, to a cylinder of an internal combustion engine. It further comprises a second conduit for conducting a flow of a first gas such as air, from a source to a cylinder of the internal combustion engine. The first and second conduits have a common termination at a common location.

A cap is provided and disposed over the common termination of the first and second conduits. The cap has an opening formed in it. The common termination and the cap are arranged to cause the liquid fuel to form a mist within the cap in response to the flow of the first gas from the second conduit. The present invention further comprises a third conduit associated with an internal combustion engine for directing a flow of a second gas into a combustion chamber of the internal combustion engine. The opening formed in the cap of the nozzle is disposed in fluid communication with a third conduit in order to cause the mist to pass from the cap into the third conduit.

The first and second conduits can be disposed in coaxial and concentric relation with each other. The second conduit can be disposed around the first conduit. The first gas can be air provided at atmospheric pressure and the liquid fuel can be gasoline. The opening in the cap can be formed in a side of the cap which requires the first gas and the liquid fuel, as a mist, to turn at an approximately right angle in order to pass through the opening in the cap after leaving the common termination of the first and second conduits. The cap can be generally cylindrical with a closed end and an open end. The first and second conduits are disposed in the open end with the common termination being disposed within the cap.

BRIEF DESCRIPTION OF THE DRAWING

The present invention will be more fully and completely understood from a reading of the description of the preferred embodiment in conjunction with the drawing, in which.

DESCRIPTION OF THE PREFERRED EMBODIMENT

Figure 1:
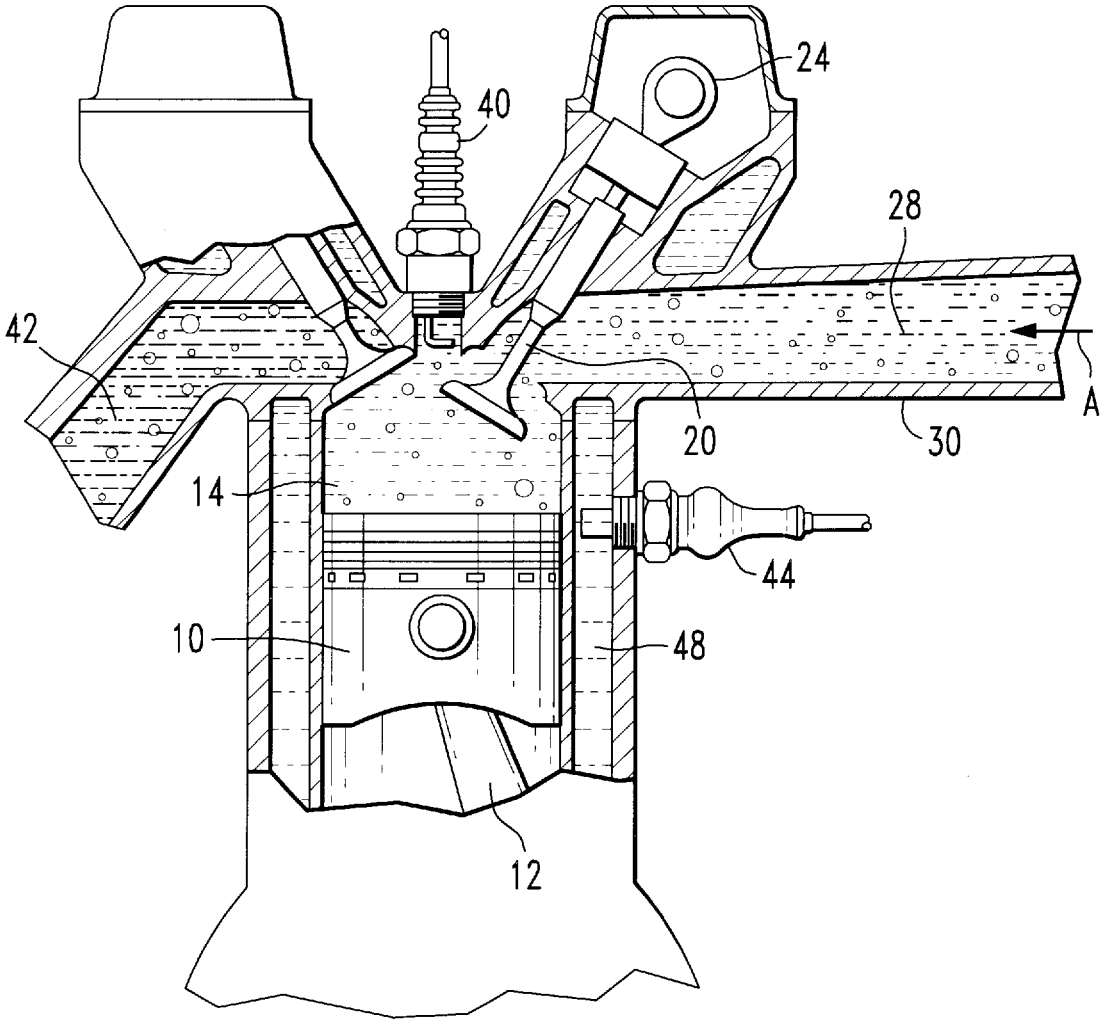
FIG. 1 PRIOR ART
FIG. 1 is a sectional view of a known arrangement of a cylinder in an internal combustion engine.

Throughout the description of the preferred embodiment, like components will be identified by like reference numerals.

In FIG. 1, a section view of an exemplary cylinder of an internal combustion engine is shown. A piston 10 is disposed in the cylinder for reciprocating motion in conjunction with connecting rod 12. Above the piston, a combustion chamber 14 is defined by the upper surface of the piston 10 and the upper end of the cylinder. Two reciprocating valves are shown in FIG. 1. An intake valve 20 is moved reciprocally in response to rotation of a cam 24. When the valve 20 opens its associated port, a fuel-air mixture 28 flows from an intake structure 30 into the combustion chamber 14. Upstream from the combustion chamber 14, and not shown in FIG. 1, is some form of fuel atomization device. The fuel atomization can be accomplished by a carburetor connected in fluid communication with the intake manifold, or, alternatively, by a fuel injector. These techniques are well known to those skilled in the art. When a fuel injector is used, it is sometimes typical to provide high pressure air to the injector from a compressor. This air is typically provided to the injector at a pressure of approximately 10 pounds per square inch. The use of a compressor increases the cost and complexity of an internal combustion engine system.

Also shown in FIG. 1 is a spark plug 40, an exhaust port 42, and a temperature measuring device 44 which is connected in thermal communication with the cooling system 48 shown in FIG. 1. The fuel-air mixture passes toward the combustion chamber 14 in the direction represented by arrow A.

Figure 2:
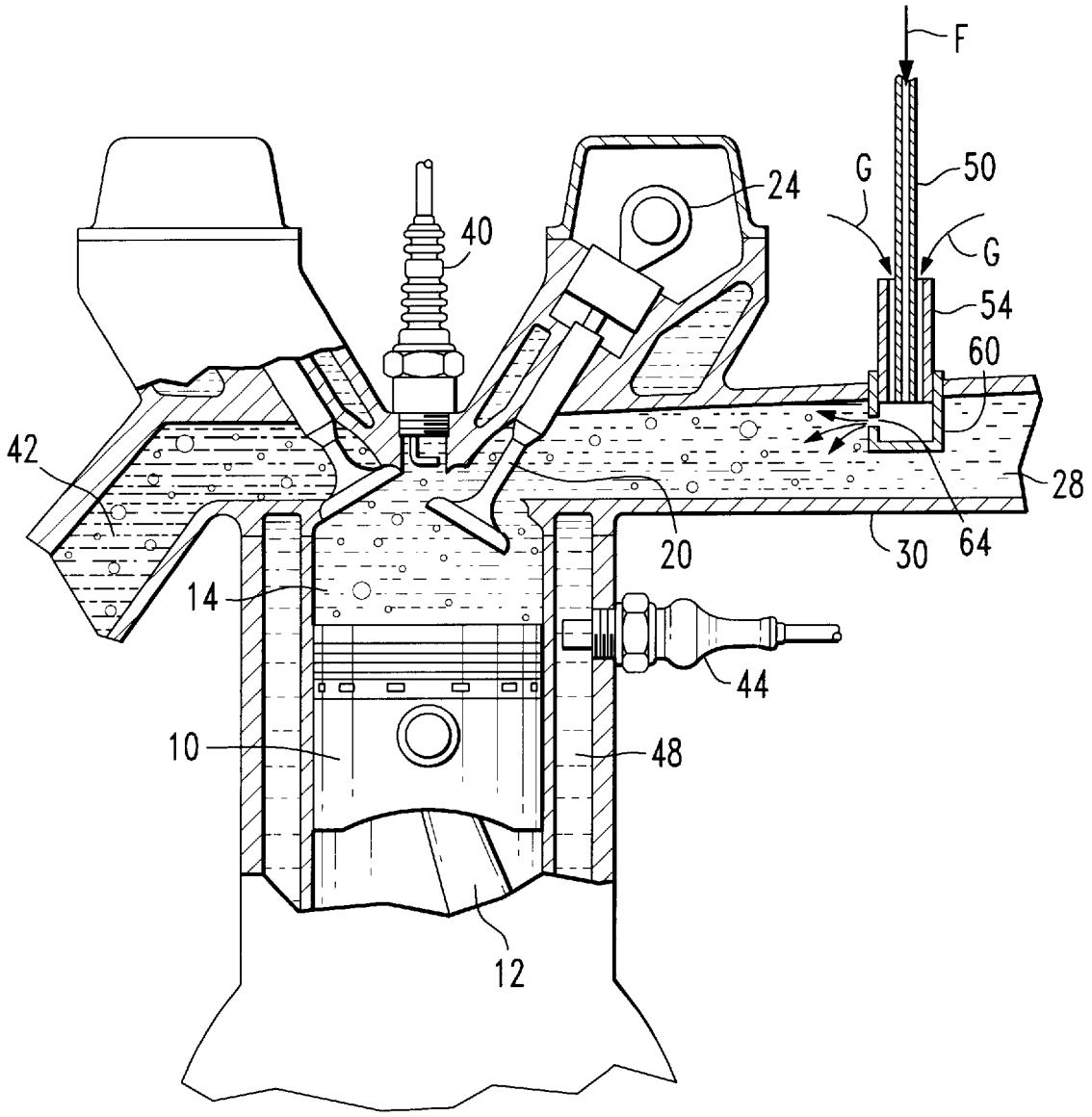
FIG. 2 is an internal combustion engine cylinder with the nozzle of the present invention disposed within an intake manifold of the engine.

FIG. 2 shows the same components as FIG. 1, but with the addition of a nozzle made in accordance with the present invention. A first conduit 50 and a second conduit 54 are shown in coaxial and concentric relation with each other. A supply of liquid fuel F, as represented by the arrow in FIG. 2, is provided to the first conduit 50 by a fuel pump or some other appropriate device. A flow of a gas G, such as air at atmospheric pressure, is provided to the space between the first and second conduits. The gas flows within the second conduit 54 and the liquid fuel flows within the first conduit 50. The first and second conduits have a common termination as shown. The common termination is disposed within a cap 60. The cap 60 is provided with an opening 64. In FIG. 2, the opening 64 is shown extending through a wall of the cap 60. In a preferred embodiment of the present invention, the cap 60 is generally cylindrical and has a closed end and an open end as illustrated in FIG. 2. The first and second conduits, 50 and 54, are disposed within the open end of the cap 60. As the fuel F is caused to flow through the first conduit 50, air at atmospheric pressure is drawn into the second conduit 54. As the liquid fuel and the air reach the common termination of the first and second conduits within the cap 60, the liquid fuel is atomized into a fine spray or mist. This mist then passes through the opening 64 as represented by the arrows emanating from the opening 64 in FIG. 2. The mist is then sprayed into a third conduit, such as the intake manifold 30, to be entrained within the air stream 28 as it flows toward the combustion chamber 14.

Figure 3:
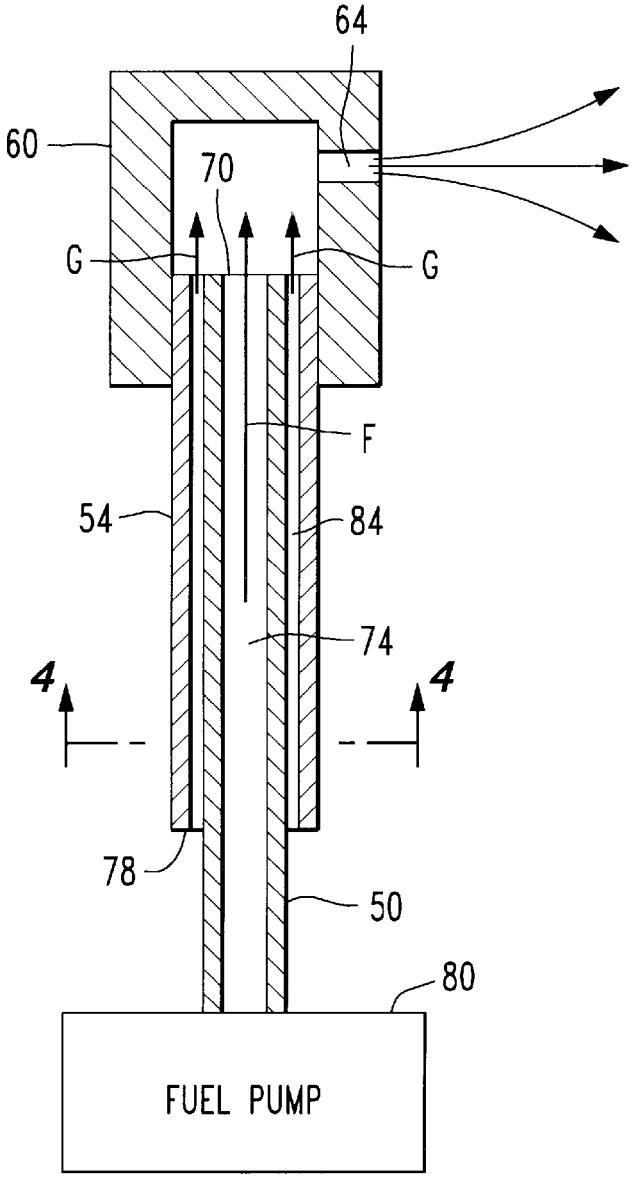
FIG. 3 is a detailed view of the nozzle of the present invention.

In FIG. 3, the cap 60 is illustrated with the first conduit 50 and second conduit 54 having a common terminus within the cap 60. In the embodiment shown in FIGS. 2 and 3, the common termination of the first and second conduit is disposed within a plane 70. The ends of the first and second conduits are both disposed in this plane. However, it should be understood that alternative configurations of the present invention could provide a slight difference in position between the ends of the first and second conduits. As the liquid fuel F flows through the bore 74 of the first conduit 50 and reaches the end of the first conduit within the cap 60, it is atomized within the stream of air flowing from the end of the second conduit 54 within the cap 60. The air is drawn, at atmospheric pressure, through the other end 78 of the second conduit 54. The fuel F is provided at a pressure of approximately 1 psig by a fuel pump 80. Since the intake manifold is at a vacuum, the differential pressure experienced by the fuel is approximately 11 psi.

Figure 4:
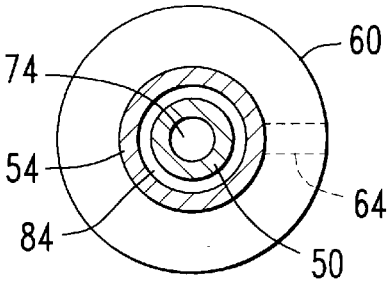
FIG. 4 is a section view of FIG. 3.

FIG. 4 is a section view of FIG. 3 showing a second conduit 54, the first conduit 50, the bore 74 within the first conduit 50 and the space 84 between the first and second conduits. The liquid fuel flows within the bore 74 and the air flows within the space 84 as these two fluids both move through their respective passages toward the common termination within the cap 60.

With reference to FIGS. 3 and 4, the two fluids are mixed at the common termination within the cap 60 and a fine mist is formed within the cap. This mist then flows out of opening 64. In the embodiment shown in FIG. 3, the mist is formed immediately above the common termination of the first and second conduits and turns at a right angle in order to pass through opening 64. When associated with an intake manifold, as illustrated in FIG. 2, the mist is then carried by the air stream within the intake manifold and transported into the combustion chamber 14.

The configuration shown in FIG. 3 has been determined to effectively create a fine mist of fuel in the form of extremely small droplets. The nozzle of the present invention performs this important function even when the fuel flow rate is significantly reduced, such as when the internal combustion engine is running at idle speed. By providing a fine mist even at very low engine speeds, the nozzle of the present invention makes it possible to utilize a low pressure fuel injector which does not require the provision of an air compressor.

Although the present invention has been described with particular specificity and illustrated to show one specific embodiment of the present invention, it should be understood that alternative embodiments are also within its scope.

I claim:

1. A nozzle, comprising:

a first conduit for conducting a flow of liquid fuel;

a second conduit for conducting a flow of a first gas, said first and second conduits having a common termination at a common location;

a cap disposed over said common termination, said cap having an opening formed therein, said common termination and said cap being arranged to cause said liquid fuel to form a mist within said cap in response to the flow of said first gas from said second conduit; and a third conduit associated with an internal combustion engine for directing a flow of a second gas into a combustion chamber of said internal combustion engine, said opening formed in said cap being disposed in fluid communication with said third conduit to cause said mist to pass from said cap into said third conduit.

2. The nozzle of claim 1, wherein:

said second conduit is disposed in coaxial and concentric relation around said first conduit.

3. The nozzle of claim 1, wherein:

said first and second conduits being arranged in concentric and coaxial relation with each other.

4. The nozzle of claim 1, wherein:

said first gas is air.

5. The nozzle of claim 4, wherein:

said first gas is air at atmospheric pressure at an entrance of said second conduit.

6. The nozzle of claim 1, wherein:

said second gas is air.

7. The nozzle of claim 1, wherein:

said opening is formed in a side of said cap which requires said first gas and said liquid fuel, as a mist, to turn at an approximately right angle to pass through said opening in said cap after leaving said common termination.

8. The nozzle of claim 1, wherein:

said cap is generally cylindrical with a closed end and an open end, said first and second conduits being disposed in said open end, said common termination being disposed within said cap.

9. The nozzle of claim 1, wherein:

said first conduit is a first tube and said second conduit is a second tube, said first and second tubes being disposed in coaxial and concentric relation with each other.

10. The nozzle of claim 1, wherein:

said liquid fuel is gasoline.

11. A nozzle, comprising:

a first conduit for conducting a flow of liquid fuel;

a second conduit for conducting a flow of a first gas, said first and second conduits having a common termination at a common location, said second conduit being disposed in coaxial and concentric relation around said first conduit;

a cap disposed over said common termination, said cap having an opening formed therein, said common termination and said cap being arranged to cause said liquid fuel to form a mist within said cap in response to the flow of said first gas from said second conduit; and a third conduit associated with an internal combustion engine for directing a flow of a second gas into a combustion chamber of said internal combustion engine, said opening formed in said cap being disposed in fluid communication with said third conduit to cause said mist to pass from said cap into said third conduit.

12. The nozzle of claim 11, wherein:

said first gas is air at atmospheric pressure at an entrance of said second conduit.

13. The nozzle of claim 11, wherein:

said second gas is air.

14. The nozzle of claim 11 , wherein:

said opening is formed in a side of said cap which requires said first gas and said liquid fuel, as a mist, to turn at an approximately right angle to pass through said opening in said cap after leaving said common termination.

15. The nozzle of claim 11, wherein:

said cap is generally cylindrical with a closed end and an open end, said first and second conduits being disposed in said open end, said common termination being disposed within said cap.

16. The nozzle of claim 11, wherein:

said first conduit is a first tube and said second conduit is a second tube, said first and second tubes being disposed in coaxial and concentric relation with each other.

17. The nozzle of claim 11, wherein:

said liquid fuel is gasoline.

18. A nozzle, comprising:

a first conduit for conducting a flow of liquid fuel;

a second conduit for conducting a flow of a first gas, said first and second conduits having a common termination at a common location, said second conduit being disposed in coaxial and concentric relation around said first conduit;

a cap disposed over said common termination, said cap having an opening formed therein, said common termination and said cap being arranged to cause said liquid fuel to form a mist within said cap in response to the flow of said first gas from said second conduit, said opening being formed in a side of said cap which requires said first gas and said liquid fuel, as a mist, to turn at an approximately right angle to pass through said opening in said cap after leaving said common termination; and a third conduit associated with an internal combustion engine for directing a flow of a second gas into a combustion chamber of said internal combustion engine, said opening formed in said cap being disposed in fluid communication with said third conduit to cause said mist to pass from said cap into said third conduit, said cap being generally cylindrical with a closed end and an open end, said first and second conduits being disposed in said open end, said common termination being disposed within said cap.

19. The nozzle of claim 18, wherein:

said first gas is air at atmospheric pressure at an entrance of said second conduit;

said liquid fuel is gasoline; and said second gas is air.

20. The nozzle of claim 18, wherein:

said first conduit is a first tube and said second conduit is a second tube, said first and second tubes being disposed in coaxial and concentric relation with each other.

* * * * *